US008398073B2

(12) United States Patent
Hsu et al.

(10) Patent No.: US 8,398,073 B2
(45) Date of Patent: Mar. 19, 2013

(54) AUTOMATIC DOCUMENT FEEDER

(75) Inventors: Wei-Hsun Hsu, Taipei (TW); Wen-An Huang, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 213 days.

(21) Appl. No.: 12/716,578

(22) Filed: Mar. 3, 2010

(65) Prior Publication Data

US 2011/0169212 A1 Jul. 14, 2011

(30) Foreign Application Priority Data

Jan. 8, 2010 (TW) ..... 99100390 A

(51) Int. Cl.
*B65H 3/34* (2006.01)

(52) U.S. Cl. ..... 271/167; 271/124; 271/145

(58) Field of Classification Search ..... 271/145, 271/109, 117, 118, 124, 167
See application file for complete search history.

(56) References Cited

U.S. PATENT DOCUMENTS 5,527,026 A * 6/1996 Padget et al. ..... 271/21
5,951,003 A * 9/1999 Nojima et al. ..... 271/121
6,382,620 B1 * 5/2002 Gaarder et al. ..... 271/117
6,485,014 B1 * 11/2002 Lin ..... 271/121
6,991,227 B2 * 1/2006 Kim ..... 271/10.12
2005/0001371 A1 * 1/2005 Otsuki ..... 271/113
2005/0242485 A1 * 11/2005 Shiohara et al. ..... 271/109
2006/0197276 A1 * 9/2006 Tanaka ..... 271/118
2007/0296138 A1 * 12/2007 Su ..... 271/109
2008/0309000 A1 * 12/2008 Tu et al. ..... 271/109
2009/0079127 A1 * 3/2009 Bokelman et al. ..... 271/121

* cited by examiner

*Primary Examiner* — Prasad Gokhale

(74) *Attorney, Agent, or Firm* — Kirton McConkie; Even R. Witt

(57) ABSTRACT

An automatic document feeder includes a sheet pick-up module and a floating shock-absorbing structure. The floating shock-absorbing structure is arranged at a feeding entrance. The sheet pick-up module includes a sheet pick-up roller and a sheet separation roller. When the sheet pick-up module is rotated to a sheet feeding position, the sheet pick-up roller is contacted with the floating shock-absorbing structure to feed the sheet into the internal portion of the automatic document feeder. By the floating shock-absorbing structure, the possibility of causing excessive shock and noise when the sheet pick-up arm strikes the feeding entrance will be minimized or eliminated.

8 Claims, 5 Drawing Sheets

AUTOMATIC DOCUMENT FEEDER

FIELD OF THE INVENTION

The present invention relates to an automatic document feeder, and more particularly to an automatic document feeder with reduced shock and noise while the sheet is fed by the sheet pick-up arm.

BACKGROUND OF THE INVENTION

An office machine such as a multifunction peripheral and an image scanning apparatus becomes an essential electronic device in the office. For continuously feeding a stack of documents to increase the scanning speed, the multifunction peripheral and the image scanning apparatus usually has an automatic document feeder. As the scanning speed is gradually increased, the speed of feeding sheets needs to be correspondingly increased. Since the sheet feeding speed becomes fast, excessive shock and noise are generated during the process of feeding the sheets. In this situation, the useful life of the automatic document feeder is shortened.

FIG. 1 is a schematic view illustrating an automatic document feeder disclosed in U.S. Pat. No. 6,792,241. As shown in FIG. 1, the automatic document feeder 1 comprises a sheet pick-up arm 10, a sheet pick-up roller 11, a sheet separation pad 12 and a sheet separation roller 13.

The sheet pick-up arm 10 of the automatic document feeder 1 is used for feeding the sheets S into the inner portion of the automatic document feeder 1. Depending on different sheet-feeding statuses, the sheet pick-up arm 10 may be switched between a standby position and a sheet feeding position. As shown in FIG. 1, the sheet pick-up arm 10 is in the standby position.

FIG. 2 is a schematic view illustrating the automatic document feeder of FIG. 1, in which the sheet pick-up arm is in a sheet feeding position. When the scanning operation is activated, the sheet pick-up arm 10 is lowered to the sheet feeding position. As such, the sheets S will be successively fed into the sheet feeding path D through a feeding entrance C by the sheet pick-up roller 11. Correspondingly, the sheets S are successively separated from and transported into the inner portion of the automatic document feeder 1.

The conventional automatic document feeder 1, however, still has some drawbacks. As previously described, the sheet pick-up arm 10 of the automatic document feeder 1 should be switched from the standby position to the sheet feeding position in order to feed sheets. For further increasing the sheet feeding speed, the office machine having the automatic document feeder needs to increase the speed of rotating the sheet pick-up arm 10 from the standby position to the sheet feeding position. As such, the striking force applied on the feeding entrance C by the pick-up arm 10 becomes stronger, and excessive shock and noise are generated. In this situation, the use life of the sheet pick-up arm 10 is shortened. Therefore, there is a need of an automatic document feeder with reduced shock and noise during the process of feeding sheets by the sheet pick-up arm in order to obviate the drawbacks encountered from the prior art.

SUMMARY OF THE INVENTION

It is an object of the present invention to provide an automatic document feeder having a floating shock-absorbing structure arranged at a feeding entrance thereof. By the floating shock-absorbing structure, the possibility of causing excessive shock and noise when the sheet pick-up arm strikes the feeding entrance will be minimized or eliminated.

In accordance with an aspect of the present invention, there is provided an automatic document feeder for feeding a sheet. The automatic document feeder includes a sheet pick-up module and a floating shock-absorbing structure. The sheet pick-up module includes a driving shaft and a sheet pick-up arm. The driving shaft is installed on the automatic document feeder. The sheet pick-up arm is pivotally coupled to the driving shaft, and includes a sheet pick-up roller and a sheet separation roller. When the sheet pick-up arm is in a sheet feeding position, the sheet is fed into an internal portion of the automatic document feeder through a feeding entrance by the sheet pick-up roller. The floating shock-absorbing structure is arranged at the feeding entrance. When the sheet pick-up module is rotated to the sheet feeding position, the sheet pick-up roller is contacted with the floating shock-absorbing structure to feed the sheet into the internal portion of the automatic document feeder.

In an embodiment, the floating shock-absorbing structure includes a recess and a friction-enhancing pad. The friction-enhancing pad is disposed over the recess.

In an embodiment, the friction-enhancing pad includes a fixing area and a floating area. The fixing area is attached on the feeding entrance. The floating area is disposed over the recess. When the floating area is pressed by the sheet pick-up roller, the floating area is swung with respect to the fixing area.

In an embodiment, the shock-absorbing structure further includes a foam, which is disposed within the recess and aligned with a contact region between the sheet pick-up roller and the friction-enhancing pad. The foam is used for supporting a downward force applied by the sheet pick-up roller, and absorbing shock generated when the sheet pick-up roller is contacted with the friction-enhancing pad.

In an embodiment, the recess is partially occupied by the foam.

In an embodiment, the sheet separation roller is sheathed around the driving shaft. The automatic document feeder further includes a sheet separation pad. The sheet separation roller is contacted with the sheet separation pad to separate the sheet.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides an automatic document feeder. The automatic document feeder is applied to a multi-function peripheral or an automatic sheetfed scanner.

Figure 1:
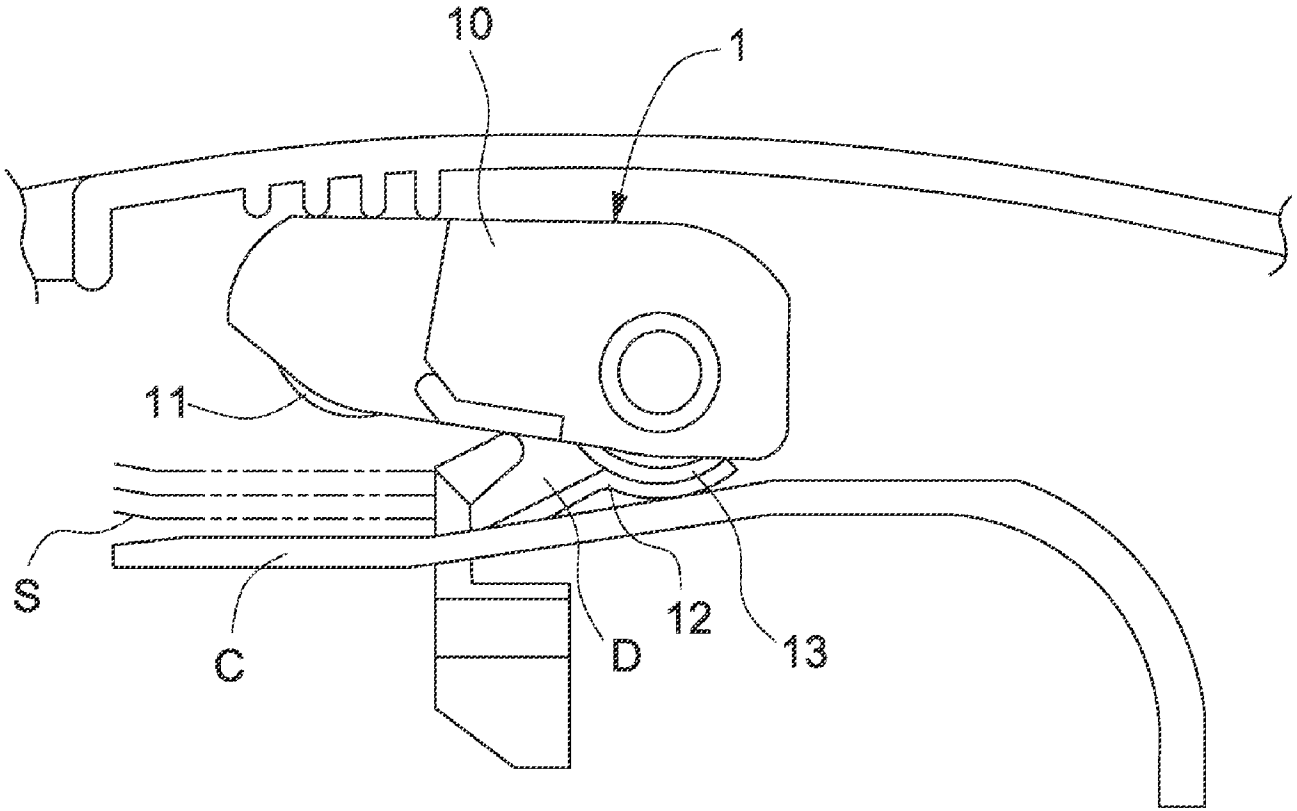
FIG. 1(PRIOR ART)
FIG. 1 is a schematic view illustrating an automatic document feeder according to the prior art, in which the sheet pick-up arm of the automatic document feeder is in a standby position.
Figure 2:
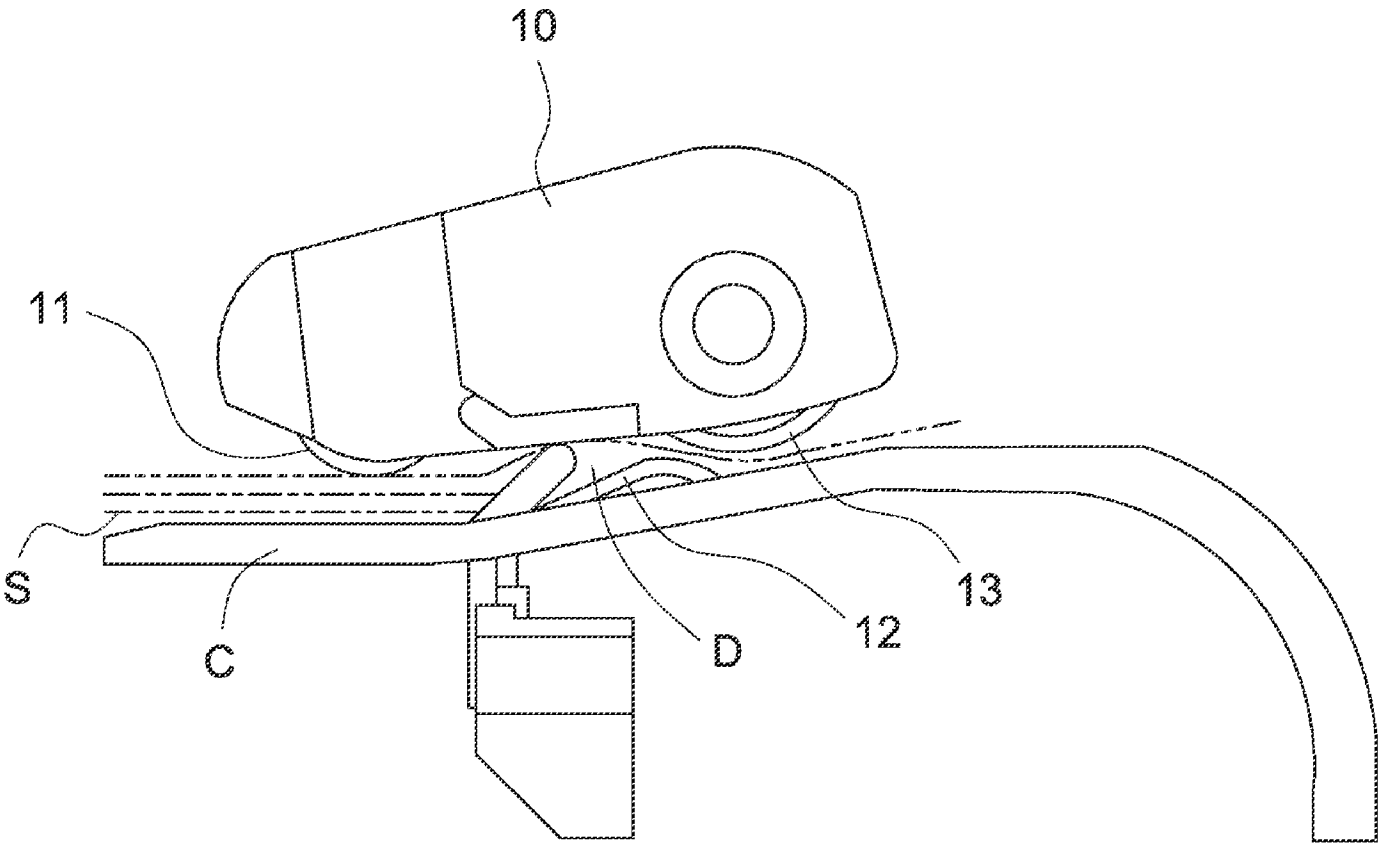
FIG. 2(PRIOR ART)
FIG. 2 is a schematic view illustrating the automatic document feeder of FIG. 1, in which the sheet pick-up arm is in a sheet feeding position.
Figure 3:
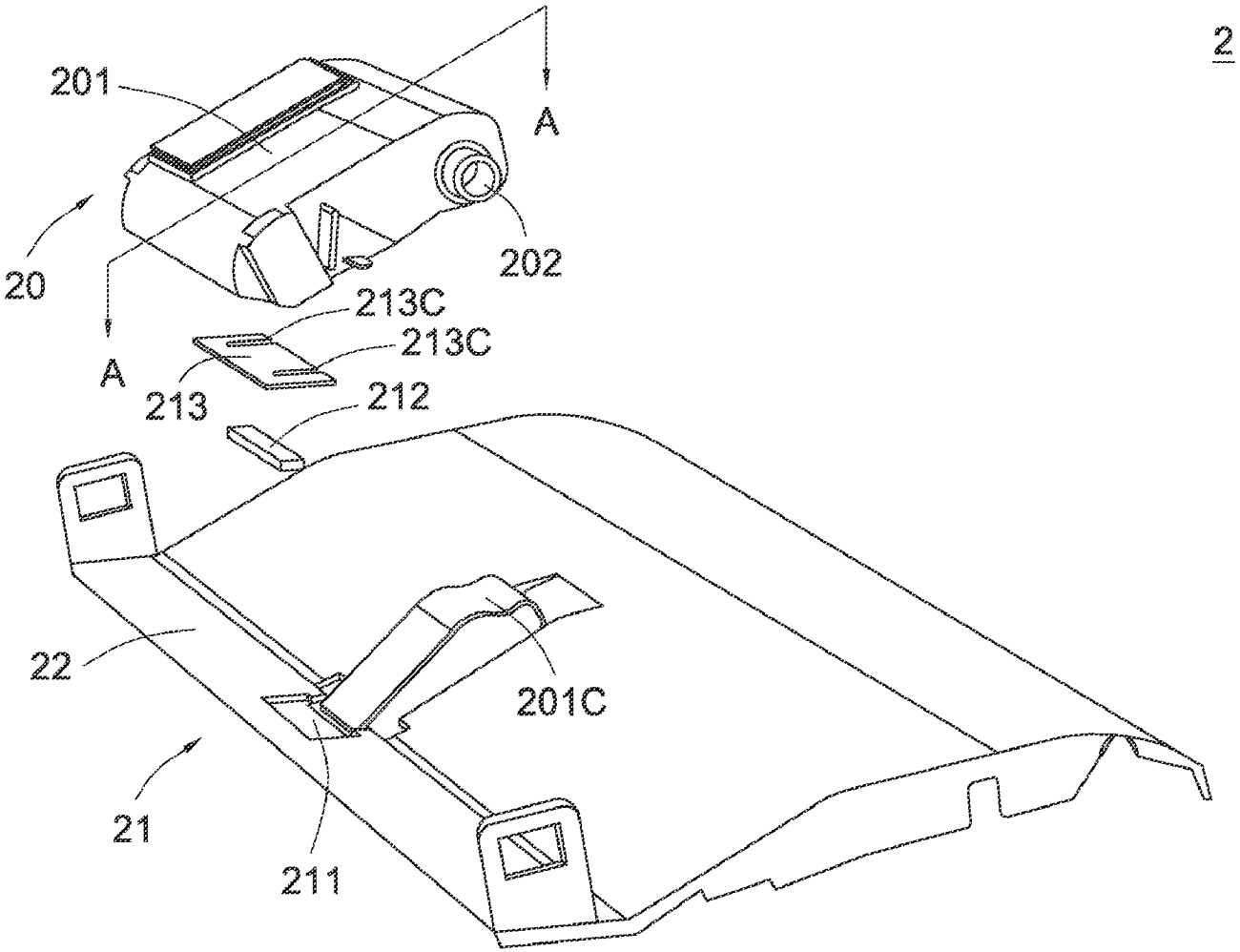
FIG. 3 is a schematic exploded view illustrating an automatic document feeder according to an embodiment of the present invention.

FIG. 3 is a schematic exploded view illustrating an automatic document feeder according to an embodiment of the present invention. As shown in FIG. 3, the automatic document feeder 2 comprises a sheet pick-up module 20 and a floating shock-absorbing structure 21. The sheet pick-up module 20 is used for feeding sheets into the internal portion of the automatic document feeder 2. The sheet pick-up module 20 comprises a sheet pick-up arm 201 and a driving shaft 202. The floating shock-absorbing structure 21 is arranged at a feeding entrance 22, and comprises a recess 211, a shock-absorbing element 212 (e.g. a foam) and a friction-enhancing pad 213.

Figure 4A:
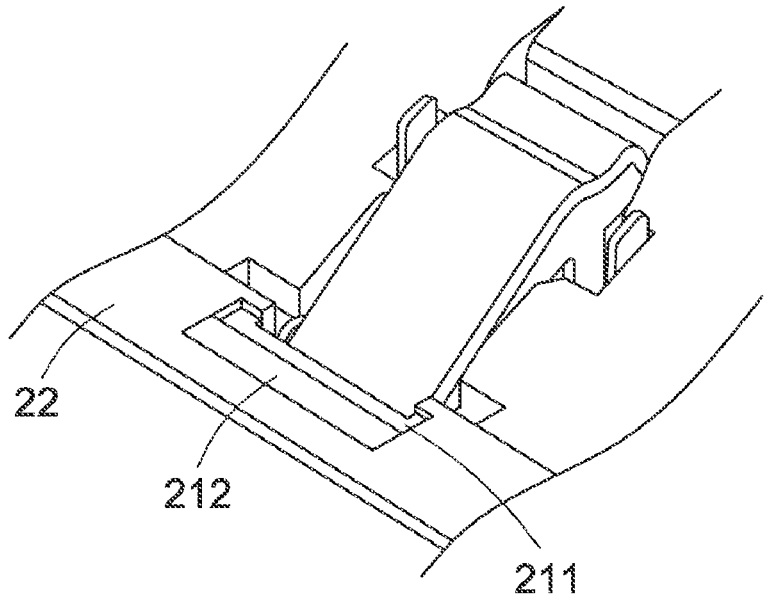
FIG. 4A is a schematic perspective view illustrating the floating shock-absorbing structure of FIG. 3, in which the foam is disposed within the recess.
Figure 4B:
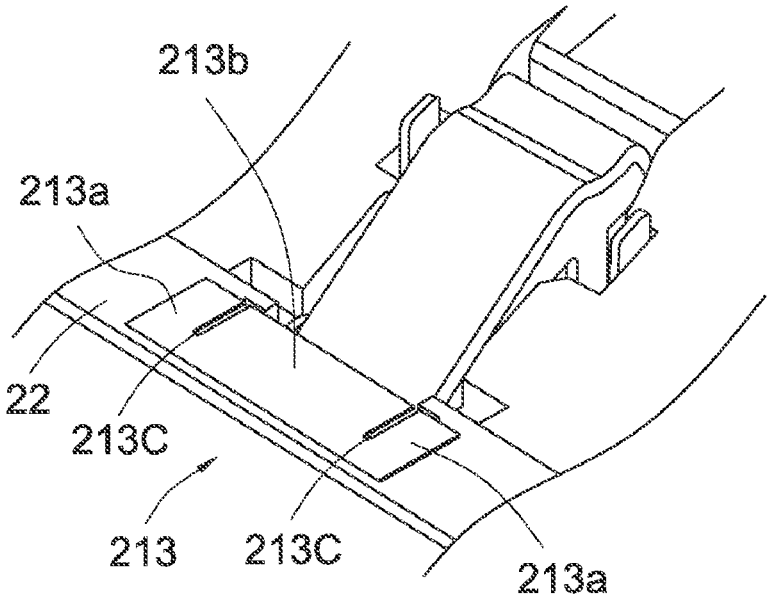
FIG. 4B is a schematic perspective view illustrating the floating shock-absorbing structure of FIG. 3, in which the friction-enhancing pad is disposed over the recess.

Please refer to FIG. 3 again. The foam 212 is disposed within the recess 211 (see also FIG. 4A). In addition, the recess 211 is not completely occupied by the foam 212. The friction-enhancing pad 213 is disposed over the recess 211 (see also FIG. 4B). The friction-enhancing pad 213 comprises a fixing area 213*a* and a floating area 213*b*. A gap 213*c* is formed between the fixing area 213*a* and the floating area 213*b*. Due to the gap 213*c*, the floating area 213*b* may be swung with respect to the fixing area 213*a* when a downward force is exerted on the floating area 213*b*. The sheet pick-up arm 201 comprises a sheet pick-up roller 201*a* and a sheet separation roller 201*b* (see FIG. 5). The driving shaft 202 is penetrated through the sheet pick-up arm 201 and sheathed around the sheet separation roller 201*b*. Moreover, as shown in FIG. 3, the automatic document feeder 2 further comprises a sheet separation pad 201*c*. The sheet separation pad 201*c* is contacted with the sheet separation roller 201*b* to separate the sheets.

Figure 5:
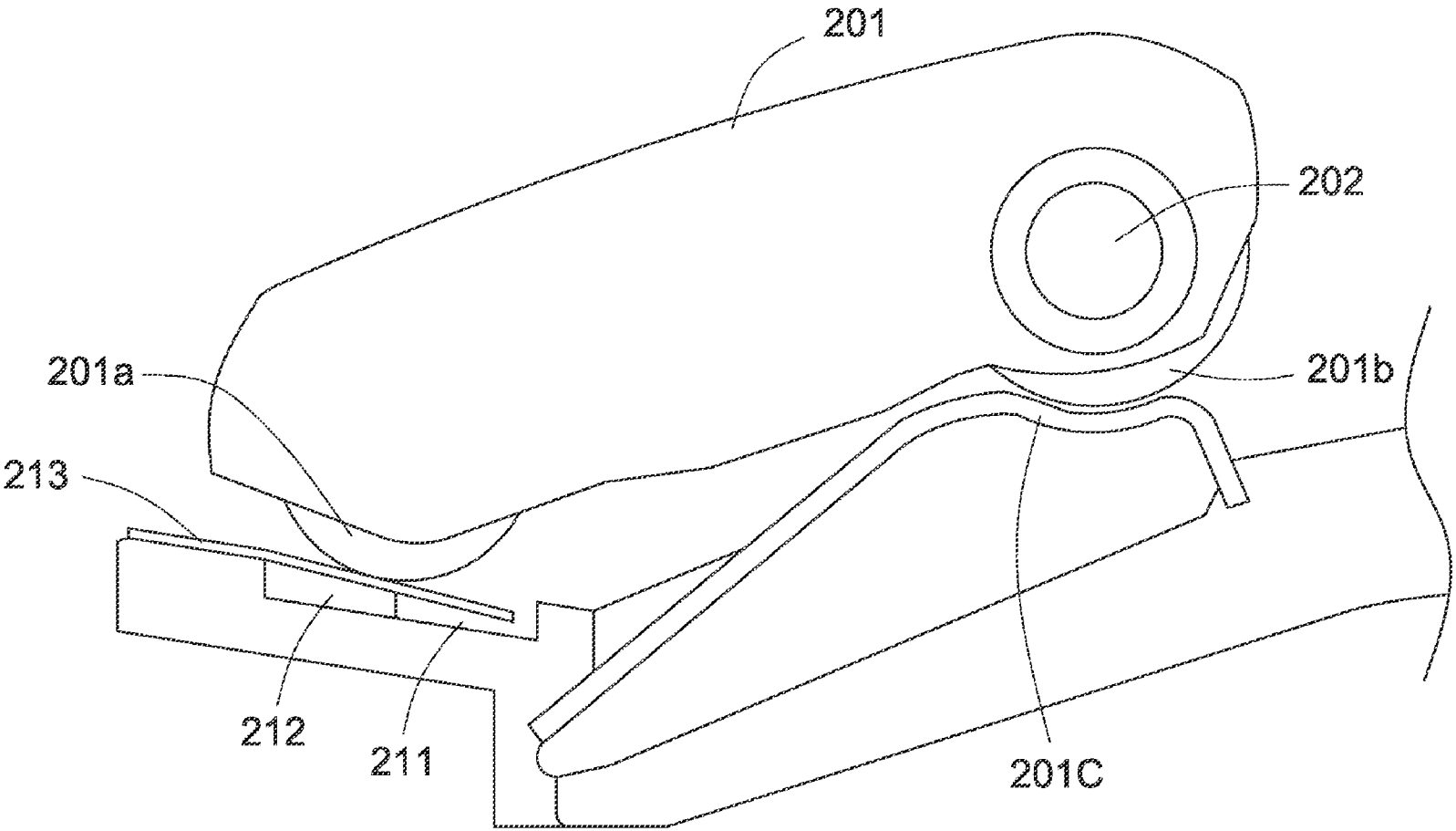
FIG. 5 is a schematic cross-sectional view illustrating the automatic document feeder of FIG. 3 and taken along the line A-A, in which the sheet pick-up arm of the automatic document feeder is in a sheet feeding position.

Hereinafter, the operations of the automatic document feeder 2 of the present invention will be illustrated with reference to FIGS. 3 and 5. FIG. 5 is a schematic cross-sectional view illustrating the automatic document feeder 2 of FIG. 3 and taken along the line A-A, in which the sheet pick-up arm 201 of the automatic document feeder 2 is in a sheet feeding position. As known, depending on different sheet-feeding statuses, the sheet pick-up arm 201 may be located at the standby position or the sheet feeding position. For performing a sheet-feeding operation, the electric current provided by the automatic document feeder 2 is transmitted to the driving shaft 202, so that the sheet pick-up arm 201 is driven by the driving shaft 202 to be rotated and lowered to the sheet feeding position. As such, the sheet pick-up roller 201*a* is contacted with the friction-enhancing pad 213 to facilitate feeding the sheets into the internal portion of the automatic document feeder 2.

Since the space of the recess 211 is not completely occupied by the foam 212, the recess 211 has a retaining space for allowing the floating area 213*b* of the friction-enhancing pad 213 to move downwardly when the floating area 213*b* is pressed by the sheet pick-up roller 201*a*. That is, when the friction-enhancing pad 213 is hit by the sheet pick-up roller 201*a*, the floating area 213*b* of the friction-enhancing pad 213 is moved downwardly within the recess 211. As a consequence, the striking force directly applied on the feeding entrance 22 by the sheet pick-up roller 201*a* is alleviated, and the noise resulted from the striking action is reduced. Moreover, since the friction-enhancing pad 213 is also supported by the foam 212 within the recess 211, the foam 212 provides elasticity to buffer the striking force or absorb the shock. In other words, the foam 212 is effective for further alleviating shock and noise.

From the above description, by means of the floating shock-absorbing structure, the automatic document feeder of the present invention has reduced shock and noise during the sheet is fed by the sheet pick-up arm. Since the floating shock-absorbing structure provides a buffering space at the contact region between the sheet pick-up roller and the feeding entrance, the sheet pick-up roller will be no longer directly strike the feeding entrance. Under this circumstance, the possibility of causing excessive shock and noise will be minimized or eliminated, the sheet pick-up arm is protected, and thus the use life of the automatic document feeder is prolonged.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding a sheet, said automatic document feeder comprising:

a sheet pick-up module comprising a driving shaft and a sheet pick-up arm, wherein said driving shaft is installed on said automatic document feeder, said sheet pick-up arm is pivotally coupled to said driving shaft, and comprises a sheet pick-up roller and a sheet separation roller, wherein when said sheet pick-up arm is in a sheet feeding position, said sheet is fed into an internal portion of the automatic document feeder through a feeding entrance by said sheet pick-up roller; and a floating shock-absorbing structure disposed at said feeding entrance and at least a portion of said floating shock-absorbing structure is moveable relative to said feeding entrance, wherein when said sheet pick-up module is rotated to said sheet feeding position, said sheet pick-up roller contacts said floating shock-absorbing structure to feed said sheet into said internal portion of said automatic document feeder, wherein said floating shock-absorbing structure comprises a recess and a friction-enhancing pad, wherein said friction-enhancing pad covers at least a portion of said recess, said friction-enhancing pad comprising:

a fixing area which secures said friction pad to said feeding entrance outside of said recess; and a floating area covers at least a portion of said recess, wherein said floating area is swung with respect to said fixing area when said floating area is pressed by said sheet pick-up roller, wherein a bottom portion of said pick-up roller contacts a top surface of said floating area when there are no sheets in said automatic document feeder and when said pick-up roller is in said sheet feeding position.

2. The automatic document feeder according to claim 1 wherein said shock-absorbing structure further comprises a foam, which is disposed within said recess and aligned with a contact region between said sheet pick-up roller and said friction-enhancing pad, for supporting a downward force applied by said sheet pick-up roller and absorbing shock generated when said sheet pick-up roller is contacted with said friction-enhancing pad.

3. The automatic document feeder according to claim 2 wherein said recess is partially occupied by said foam.

4. The automatic document feeder according to claim 1 wherein said sheet separation roller is sheathed around said driving shaft, and said automatic document feeder further comprises a sheet separation pad, wherein said sheet separation roller is contacted with said sheet separation pad to separate said sheet.

5. An automatic document feeder for feeding a sheet, said automatic document feeder comprising:

a sheet pick-up module comprising a driving shaft and a sheet pick-up arm, wherein said driving shaft is installed on said automatic document feeder, said sheet pick-up arm is pivotally coupled to said driving shaft, and comprises a sheet pick-up roller and a sheet separation roller, wherein when said sheet pick-up arm is in a sheet feeding position, said sheet is fed into an internal portion of the automatic document feeder through a feeding entrance by said sheet pick-up roller; and a floating shock-absorbing structure disposed at said feeding entrance and at least a portion of said floating shock-absorbing structure is moveable relative to said feeding entrance, wherein when said sheet pick-up module is rotated to said sheet feeding position, said sheet pick-up roller contacts said floating shock-absorbing structure to feed said sheet into said internal portion of said automatic document feeder, wherein said floating shock-absorbing structure comprises a recess and a friction-enhancing pad, wherein said friction-enhancing pad covers at least a portion of said recess, said friction-enhancing pad comprising:

a fixing area which secures said friction pad to said feeding entrance outside of said recess;

a floating area covers at least a portion of said recess, wherein said floating area is swung with respect to said fixing area when said floating area is pressed by said sheet pick-up roller; and a gap disposed between said fixing area and said floating area of said floating shock-absorbing structure.

6. The automatic document feeder according to claim 5 wherein said shock-absorbing structure further comprises a foam, which is disposed within said recess and aligned with a contact region between said sheet pick-up roller and said friction-enhancing pad, for supporting a downward force applied by said sheet pick-up roller and absorbing shock generated when said sheet pick-up roller is contacted with said friction-enhancing pad.

7. The automatic document feeder according to claim 6 wherein said recess is partially occupied by said foam.

8. The automatic document feeder according to claim 5 wherein said sheet separation roller is sheathed around said driving shaft, and said automatic document feeder further comprises a sheet separation pad, wherein said sheet separation roller is contacted with said sheet separation pad to separate said sheet.

* * * * *